US011335148B2

(12) United States Patent
Kelley et al.

(10) Patent No.: US 11,335,148 B2
(45) Date of Patent: May 17, 2022

(54) POWER-SAVING DOOR LOCK SYSTEMS AND METHODS

(71) Applicant: HAMPTON PRODUCTS INTERNATIONAL CORPORATION, Foothill Ranch, CA (US)

(72) Inventors: Kim Kelley, The Woodlands, TX (US); Jon Fong Quan, Fountain Valley, CA (US); Howard Shen, Mission Viejo, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 179 days.

(21) Appl. No.: 16/383,392

(22) Filed: Apr. 12, 2019

(65) Prior Publication Data

US 2020/0327757 A1 Oct. 15, 2020

(51) Int. Cl.

| | |
|---|---|
| ***G07C 9/00*** | (2020.01) |
| ***E05B 47/06*** | (2006.01) |
| ***E05B 47/00*** | (2006.01) |
| ***G07C 9/37*** | (2020.01) |

(52) U.S. Cl.

CPC ..... *G07C 9/00857* (2013.01); *E05B 47/0002* (2013.01); *E05B 47/0603* (2013.01); *G07C 9/0069* (2013.01); *G07C 9/00182* (2013.01); *G07C 9/00563* (2013.01); *G07C 9/37* (2020.01)

(58) Field of Classification Search

None

See application file for complete search history.

(56) References Cited

U.S. PATENT DOCUMENTS

| | | | | |
|---|---|---|---|---|
| 9,324,051 | B2 * | 4/2016 | D'Ambrosio | G06K 7/10297 |
| 9,644,400 | B1 * | 5/2017 | Cheng | G07C 9/00571 |
| 2006/0164208 | A1 * | 7/2006 | Schaffzin | G08B 29/181 340/5.64 |
| 2016/0040469 | A1 * | 2/2016 | Lietz | H02J 7/00 49/13 |
| 2016/0189503 | A1 * | 6/2016 | Johnson | G07C 9/00571 348/152 |
| 2017/0076520 | A1 * | 3/2017 | Ho | G07C 9/00309 |
| 2018/0343024 | A1 * | 11/2018 | Sahebjavaher | G06F 1/163 |

* cited by examiner

*Primary Examiner* — Carlos Garcia

(74) *Attorney, Agent, or Firm* — Klein, O'Neill & Singh, LLP

(57) ABSTRACT

An electronic door lock system that saves power by putting some electronic devices, such as transceivers, in sleep mode and by executing instructions only in response to ambient trigger scenarios. Instructions sent to an electronic door lock from a remote device could be stored on a server before being downloaded to the electronic door lock system once the transceiver is awakened from sleep mode.

21 Claims, 5 Drawing Sheets

POWER-SAVING DOOR LOCK SYSTEMS AND METHODS

BACKGROUND OF THE INVENTION

This invention relates generally to electronic door locks, and more particularly, to electronic door locks connected to a network.

Some electronic door locks typically have a key tumbler and a keypad as alternative means to lock and unlock the door. Some door locks can also connect to a network which allows a mobile device to communicate with and control the door lock. Battery life on such connected door locks becomes an issue with power hungry components.

BRIEF SUMMARY OF THE INVENTION

Aspects of the invention are in the technical field of electronic door lock systems. More particularly, aspects of the invention relate to the technical field of power-saving electronic door lock systems.

Door lock execution instructions may be sent from a remote computer system, such as a desktop computing device or a handheld computing device (e.g., laptop, cellular phone, remote device), to an electronic door lock via a network. The electronic door lock can have a variety of electronic devices and components, such as one or more transceivers, cameras, microphones, biometric sensors, user interfaces, motion sensors, door lock sensors, door open sensors, and system clocks. In order to save power, the door lock can switch at least one of the electronic devices from an active mode to a sleep mode, and only switching one or more of the electronic devices back to an active mode depending on need. Preferably, the system could configure a transceiver of the door lock used to transmit and receive signals from the server as an electronic device that can be switched from an active mode to a sleep mode to conserve power. When the transceiver is in the sleep mode (which typically renders the transceiver unable to communicate to a network), one or more door lock execution instructions that are received from one or more remote devices for a particular door lock can be stored in a memory of a server. The instructions can be stored in a queue in the order the instructions are received from the one or more remote devices. When the transceiver is in the active mode, a link or network session (e.g., Transmission Control Protocol ("TCP") session) can be established between the server and the door lock, after which the instructions in the queue can be transmitted from the server to the door lock in in any suitable manner, for example a first in, first out ("FIFO") order, by an order of importance (e.g. by cross-referencing the instructions against a weighted table providing a higher weight to instructions of one type over instructions of another type), or by an user providing an order to instructions provided by the user.

The door lock can be configured to switch one or more of the electronic devices from a sleep mode to an active mode when an electronic device of the door lock apparatus detects a triggered event. Some of the triggering mechanisms could be activated by other electronic devices that are not in sleep mode, such as a motion sensor detecting an entity in a defined area, a door lock sensor detecting a mechanical turn of a thumb turn lever to retract or extend a deadbolt, a door open sensor detecting an opening or closing the door, a door lock sensor detecting that the door is unlocked (e.g., deadbolt retracted) while the door open sensor detects that the door is in a closed state, or a user interface (e.g., keypad) receiving an input. The electronic device may be programmed to automatically switch to the sleep mode after a threshold time period of inactivity is detected. The electronic device may also be programmed to automatically switch to an active mode every so often (e.g. a threshold time period of 5, 10, 30, or 60 minutes is detected) to transmit data (e.g. status information) and to receive instructions. While a sleep mode could comprise a completely inactive state of an electronic device, such as a device that has been turned off, sleep mode could also comprise a semi-active state, such as a device where only a portion of its features have been turned off, either of which consumes less power than when all of the features of the electronic device are active.

In one embodiment, a system could be programmed to switch the transceiver to sleep mode when a motion sensor stops detecting movement or after a period of time when the motion sensor detects that no entities are in a defined area, and switches the transceiver to an active mode when the motion sensor detects that an entity is in the defined area—minimizing the amount of power the transceiver drains. When the transceiver is in the active mode, the transceiver can then contact a server via a network and download door lock instructions from the server to execute those door lock execution instructions on the door lock apparatus after a network session has been established. After a predetermined time period with no activity on the lock including no detection of motion within the defined area, the transceiver can return to the sleep mode.

In another embodiment, a door open sensor can detect if a door is in an open state or a closed state, and a door lock sensor can detect if a door lock is in a locked state or an unlocked state. When the door open sensor detects that the door is in an open state, the system could switch the transceiver to a sleep mode. When the door open sensor detects that the door is in a closed state and the door lock is in the locked state, the system could switch the transceiver to a sleep mode. When the door open sensor detects that the door is in a closed state and the door lock sensor detects that the door lock is in an unlocked state, the system could switch the transceiver to an active mode. When the transceiver is switched from a sleep state to an active state, the transceiver could establish a link (e.g., network session) between the door lock and the server, after which instructions stored on the server can be downloaded and executed by a processor, and/or an automated message could be transmitted to the remote device from the server that the door is closed but unlocked. That automated message could then trigger additional instructions to execute on the server, for example notifications to be sent to remote devices or lock instructions to be sent from the server to the door lock apparatus if a response to the sent notification is not received by the remote device within a threshold time period.

In another embodiment, a system clock allows instructions to execute only when a threshold time value has been reached. In such an embodiment, instructions could time-out, or could only be triggered within a time period, or after a threshold time value. In some embodiments, instructions could be deactivated or deleted from a memory when the system clock hits a threshold time period value, or the instructions could be stored on the server, but could be deleted from the server when a threshold time period value has been reached. Such an embodiment prevents legacy instructions from taking up valuable space in memory if the instructions no longer need to be executed since the system has detected that a threshold time value can no longer be reached.

In another embodiment, a user could interact with a user interface that triggers activation of a motor to unlock the door lock. The user can enter a code on the user interface, activating the motor when the entered code matches an unlock code stored in a memory of the door lock, and/or the user can provide a biometric characteristic recorded by a biometric sensor of the door lock, activating the motor when the entered biometric characteristic matches a biometric characteristic stored in the memory of the door lock (e.g. saved previously or downloaded from the server).

In some embodiments, an unlock code can be created by a user or dynamically generated by the app on the remote device. Once created, an unlock code command containing the unlock code can be sent to the server from the remote device, which is then relayed to the door lock if the transceiver of the door lock is in the active mode. Otherwise, if the transceiver of the door lock is in a sleep mode, the server will store the unlock code command in a queue of the server. The unlock code can be configured to be valid only within a threshold time period (e.g. by deleting the unlock code after a threshold time period has passed, or when a threshold time is reached). If the transceiver is in a sleep mode, once a motion sensor detects an entity within the defined area, the door lock could send a notification to the server, which could then transmit an unlock code command to the door lock. If the threshold time period has been met or exceeded, the door lock could delete the unlock code command after it has been downloaded to the door lock. In other embodiments, the server will remove the command from the command queue after a threshold timer period has passed. Other commands may also be configured to be valid only within a threshold time period.

These and other aspects of the invention are more fully comprehended upon review of this disclosure.

DETAILED DESCRIPTION

Figure 1:
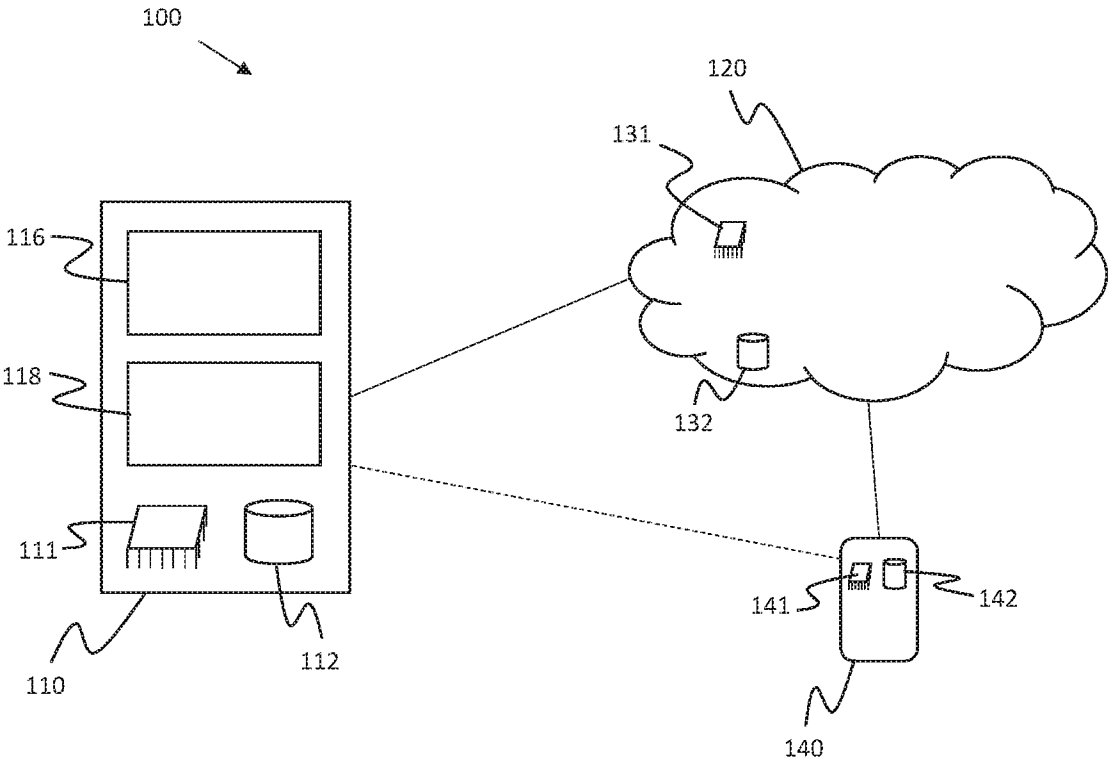
FIG. 1 is a schematic view of an embodiment of a door lock system.

Referring to FIG. 1, an embodiment of a door lock system 100 comprises a door lock 110, a server 120, and a remote computer system 140.

As used herein, a "computer system" comprises any suitable combination of computing or compute devices, such as desktops, laptops, cellular phones, blades, servers, interfaces, systems, databases, agents, peers, engines, modules, or controllers, operating individually or collectively. Computer systems and servers may comprise at least a processor configured to execute software instructions stored on a tangible, non-transitory computer readable storage medium (e.g., hard drive, solid state drive, RAM, flash, ROM, etc.). The software instructions preferably configure the computer system and server to execute the functionality as disclosed. Thus, each of door lock 110, remote server 120, and/or remote computer system 140 could comprise a plurality of distributed computer systems. Remote server 120 is preferably embodied on a network of one or more computer systems (e.g. a cloud server).

Door lock 110, server 120, and computer system 140 are euphemistically shown as directly electronically coupled to one another, but could also be indirectly electronically coupled to one another using a network (not shown) suitable for electronically coupling computer system devices to one another, and could comprise any number of suitable electronic devices for transmitting data from one electronic device to another electronic device, Such networks preferably exchange data using any suitable protocol or algorithm, for example HTTP, HTTPS, AES, public-private key exchanges, web service APIs, known financial transaction protocols, or other electronic information exchanging methods. Electronic communication can be conducted over any suitable network, and preferably a packet-switched network, the Internet, LAN, WAN, or VPN.

Elements that are functionally or electronically coupled with one another are coupled in a manner to allow for electronic communication with one another, preferably via a network. For example, a door lock 110 that is functionally coupled with a remote computer system or device 140 over a network can be coupled via a home Wi-Fi router coupled to an ISP (Internet Service Provider) modem to an intranet network that is connected to the server 120. The door lock 110 can connect with the cloud server 120 through the internet, which can be accomplished through a local wireless network or cellular connection via a transceiver of the door lock 110, as discussed in further detail below. Disclosed computer systems preferably exchange data using any suitable protocol or algorithm, for example HTTP, HTTPS, AES, public-private key exchanges, web service APIs, known financial transaction protocols, or other electronic information exchanging methods. Electronic communication can be conducted over any suitable network, and preferably a packet-switched network, the Internet, LAN, WAN, or VPN.

In one embodiment, door lock 110 can be an electronic lock that may be unlocked using a key in embodiments where a tumbler is provided to unlock a lock, or by using an application on the remote computer system or device 140 that transmits commands to door lock 110 to activate a motor to unlock a lock. In some embodiments, door lock 110 may also be unlocked by verification of a received unlock code entered on a keypad of the door lock 110 or by verification of a matching characteristic received from a biometric sensor (e.g. biometric sensor 348 of FIG. 3) of the door lock 110. Besides unlocking, other functions of the door lock 110 may include locking the door, receiving and storing e-codes (unlock codes) and e-keys (allow other remote devices to unlock the door), transmitting the status of the lock via a transmitter, and recording the method of entry, time of entry, and which e-codes, e-keys, or biometric characteristics were used (recording via sensors and saving such records to a memory). These functions can be executed by instructions (commands) transmitted from the remote device 140. Communication between the door lock 110 and the remote device 140 may be managed and/or controlled through the cloud server 120. In some embodiments, communication may be peer-to-peer between the door lock 110 and the remote device 140. The cloud server 120 may also store and process data and commands between the door lock 110 and the remote device 140 in the form of a queue, discussed in detail below.

The door lock 110 can comprise a door lock processor 111, a door lock memory 112, electronic devices 116, including a transceiver, and mechanical components 118, as described in detail below with reference to FIGS. 2-4. One or more of the electronic devices 116 may have both a "sleep state" or low-power state and an "active state." As used herein, the sleep state is a state that requires less power than the active state. In the sleep state, a portion of the hardware of the electronic device may not be on, a standby state which activates faster than when the device is turned on from an off state. The transceiver comprises any device that could be used to transmit data via a network connection—preferably a wireless network connection. Contemplated transceivers may include Wi-Fi, Bluetooth, infrared, microwave, cellular, satellite, radio, and light wave transceivers. In some embodiments, the door lock 110 could comprise a plurality of transceivers, for example a Bluetooth transceiver used to communicate with a mobile device, and a Wi-Fi transceiver used to communicate over a larger network, such as the Internet. In other embodiments, a single transceiver with a wide range of frequencies or different protocols may be used, such as a combination Bluetooth/Wi-Fi transceiver.

As used herein, a threshold time value could be any suitable time threshold used with an electronic clock. For example, a threshold time value could be defined as after a time (e.g. after 3:00 PM or after an hour), before a time (e.g. before 3:00 PM or before an hour has elapsed), within a time period (e.g. between 3:00 PM and 3:30 PM or within the next thirty minutes), or within a series of time periods (e.g. between 1:00 PM and 4:00 PM every weekday or for ten minutes every hour).

Mechanical devices 118 are devices that are not electronic, but may be acted upon by any of electronic devices 116. Some mechanical devices 118 could be static, such as a door strike plate or a door lock mounting plate, or could be dynamic, such as a bolt or a latch assembly. Electronic devices that act upon mechanical devices 118 could include, for example, motors that change a mechanical door lock or bolt from a locked state to an unlocked state or a magnet that detects a door lock's proximity to a strike plate. In preferred embodiments, door lock 110 could be locked or unlocked either via an electronic motor or via a key. Keys could be mechanical (e.g. pin-coded key) or electronic (e.g. RFID or Bluetooth), but preferably electronic keys act upon door lock 110 without utilizing a command sent through a network transceiver of door lock 110 (e.g. via an RFID transceiver that detects an RFID key swiped in front of a sensor, not via a command downloaded via a Wi-Fi network connection).

As used herein, an e-code is a code that can be utilized by any entity (e.g. alphanumeric code, symbol, input sequence). Any suitable user interface/sensor could be used to receive an e-code. Preferably, such electronic devices are in sleep mode until door lock processor 111 changes their state in response to a triggering instruction or other suitable signal. Any combination of e-codes could be required by door lock 110 to activate the unlocking motor.

The computer processor 111 executes instructions saved on non-transient computer-readable memory 112 to operate the electronic devices 116. The computer processor 111 can switch the state of at least one of the electronic devices 116 to a sleep mode until a trigger is received. Some electronic devices can include motion sensors, door lock sensors, door open sensors, biometric sensors, magnetic sensors, system clocks, transceivers, cameras, microphones, and user interfaces. Any electronic device could be dynamically designated to have a sleep state, depending upon the software on the memory 112, so a firmware update or an updated set of instructions may alter which of the electronic devices 116 have a sleep state.

Any suitable sensor could be used as a motion sensor, which detects whether an entity is within a defined area. Motion sensors include PIR (Passive Infra-Red), microwave, vibration, and ultrasonic motion sensors. In some embodiments, a video camera may be used as a motion sensor, although preferred embodiments use PIR motion sensors as video cameras typically have higher power requirements. The area monitored by a motion sensor could be defined and/or redefined by a user of the system, and a plurality of areas could be defined, each area being monitored at different defined threshold time period values.

A door lock sensor could be used to detect whether a door lock is in a locked state. In some embodiments, a door lock sensor could comprise a mechanical switch that is pressed by a portion of a mechanical device when a door is locked (e.g. a switch that is depressed by an end of a deadbolt or turn lever of component coupled between the deadbolt and turn lever, when it is in the locked or unlocked position), or an electromagnet that detects the presence, absence, or a proximity of a magnet placed in or on a door frame, or a strike box, or magnet within the door lock (e.g. an electromagnet that detects when a deadbolt has moved towards or away from the electromagnet). The door lock sensors could be configured to detect a plurality of locking engagement mechanisms for the same door lock.

A door open sensor could be used to detect whether or not a door is in an opened state. As used herein, both doors and locks are referred to as being in an open state when the door is in an opened state. Many different sensors could be used as a door open sensor, for example a circuit that is closed when two parts of the door lock come in contact with one another (e.g. a strike plate with a face plate or latch), a magnetic sensor that detects the presence, absence, or proximity of a magnet in from the magnetic sensor, or a simple mechanical switch that is pressed when the door is in a closed state.

A user interface could comprise any device that could be used to allow a user to input data to the door lock 110, for example a keypad, a touch screen, a keyboard, a mouse, or a touchpad. The user interface is preferably tactile, but could accept any sort of input, such as audio, visual, or vibrational input. Preferably the user interface is used to accept some code, such as a numeric or alphanumeric code, which allows the door lock 110 to verify whether a person attempting to unlock the door lock 110 has appropriate authorization to do so. The code could be generated by a processor 111 of the door lock 110, set by a user through the user interface, or randomly generates or set by a user through the remote device, which is then transmitted to the door lock 110 by the server 130 as an instruction downloaded by the door lock 110.

The server 120 is shown euphemistically as a cloud server having a processor 131 and a memory 132, however the server 120 could be any suitable computer system or systems, including a cloud computing system having an internal or external memory database 132 capable of enabling communication between the remote device 140 and the door lock 110. In some embodiments, the server 120 could act as a simple proxy to the remote device 140, allowing the remote device 140 to transmit data to/from the door lock 110 with a simple identifier, such as a user ID and/or a password. In other embodiments, server 120 could store commands sent from the remote device 140 to door lock 110 in a queue, which is sent to the door lock 110 when the door lock 110 is wakened from a sleep state to an active state, capable of connecting with the server 120.

The memory 132 of the server 120 preferably holds authentication information for one or more users of the door lock 110. In such embodiments, when the remote device 140 communicates with the server 120, the server 120 could compare authentication information (e.g. a username and password) received from the remote device 140 against authentication information saved on the memory 132 to determine whether the remote device 140 is authorized to communicate with the door lock 110. Several users and/or several remote devices could be configured to be able to communicate with a single door lock, and likewise a single user could be configured to be able to communicate with a plurality of door locks. Once a user and/or a remote device 140 has been authenticated, the remote device 140 can use the server 120 to transmit one or more commands to the door lock 110. In one embodiment, the door lock 110 communicates with any number of discrete and/or distributed computer systems via the server 120, such as the remote device 140. While FIG. 1 shows only one door lock 110 and one remote device 140 functionally coupled to one another via only one server 120, any number of door locks 110 and remote devices 140 may be functionally coupled to one another via any number of servers. In some embodiments, a single distributed server is configured to communicate with a plurality of remote devices, each one being configured to communicate with the distributed server and one or more door locks. In some embodiments, a door lock network hub (not shown) acts as a relay or extender located within a short distance (e.g. less than 40, 20, or even 10 meters from door lock 110) for enabling communication with an ISP modem to connect the door lock 110 with the server 120.

The remote device 140 is shown euphemistically as a cellular phone having a processor 141 and memory 142. However, the remote device 140 could be any suitable computer system or systems, including a desktop computer, other wireless handheld device, or even a remote computer system accessing the server 120 via a web page. The remote device 140 comprises a computer system having an installed application, app, or applet on its memory 142 that allows electronic communications to be sent to/from the door lock 110. The remote device 140 may communicate with the door lock 110 via the server 120, which could accept commands stored in a command queue of the server 120 when the transceiver of the door lock 110 is in a sleep state, and later sent to the door lock 110 when the transceiver of the door lock 110 is in an active state.

In some embodiments, the remote device 140 can also be configured to communicate directly with door lock 110 when it is within a shorter proximity range to the door lock 110 than normal—for example within 40 meters of the remote device 140. In such embodiments, the door lock 110 preferably has a plurality of transceivers, for example a Bluetooth transceiver and a Wi-Fi transceiver or a combination Bluetooth and Wi/Fi transceiver, where the first is configured to directly communicate with the remote device 140 and the second is configured to communicate with the remote device 140 over a network via the server 120. Such embodiments could be useful for setup reasons (e.g. setup door lock 110 to communicate with a home Wi-Fi network using a Bluetooth connection), or to provide multiple avenues of communication with the door lock 110.

To conserve battery life, the transceiver of the door lock 110 may be placed in a sleep state, and preferably only connects with the server 120 when a trigger wakes up the transceiver, or if the transceiver is configured to periodically awaken to connect to the server 120 with an instruction request. When the server 120 receives a request for instructions, the server 120 could then search its memory 132 for queued instructions, which are then transmitted to the door lock 110.

In some embodiments, a command that is sent to the server 120 could be sent with a time expiration period that will cause, upon time expiration, either the server 120 to delete the command or the door lock 110 to delete the command after receiving the command from the server. For example, the server 120 could be configured to transmit a command to the door lock 110 to open the door if a person at the door enters a code to the door before 5:00 PM. If the server 120 detects that 5:00 PM has passed, but no instruction has been requested from the door lock 110, then the server 120 could delete the expired instruction before it can be sent to door lock 110, or the door lock 110 can delete the expired instruction after it is downloaded from the server 120. The expiration trigger could apply to one or both of the server 120 and the door lock 110, such that the door lock 110 could receive a set of instructions, and delete/inactivate those instructions if a triggering time value threshold is reached. Such time value thresholds are typically triggered by comparing the threshold value against a system clock of the server 120 and/or the door lock 110.

In other embodiments, a request does not need to be sent from the door lock 110, and the server 120 could simply transmit instructions to door lock 110 as soon as it detects that door lock 110 is online (e.g., a TCP session between the door lock and the server).

The server 120 could be configured to save any number of instructions for transmission to the door lock 110. When instructions are sent to the door lock 110 via the server 120, the server 120 can save these instructions in a queue on memory 132, which will then be sent from the server 120 to the door lock 110 when the server 120 receives a trigger. The queue could be configured to be asynchronous or FIFO—to be executed either in the order the commands were received or in accordance with time-stamps, or in accordance with an ordering defined by an admin user or a template. When the door lock 110 receives the instructions from the server 120, those instructions could then be executed by the door lock 110.

Any suitable trigger could be used to trigger the door lock 110 to transmit a request for downloading instructions from the server 120. In some embodiments, while the transceiver of the door lock 110 is in sleep mode, the transceiver could periodically activate and send a request to the server 120 to send instructions to the door lock 110. Such periods could be configurable by a user of the system, such as a user of the remote device 140, or could be set to a default time value. In other embodiments, an active electronic device could be a sensor that is monitored by the door lock processor 111, such as a motion sensor. When the motion sensor senses an entity within a defined area, the processor 111 could change the state of a transceiver from a sleep state to an active state, and could then send a request for instructions to the server 120 for downloading. A user interface on the door lock 110 could also be used to trigger the download, or even a vibration sensor monitoring the state of a door handle could be used, which would trigger a download when it senses a vibration from the door handle (usually an indication that a person is attempting to turn the door handle while the door handle is locked).

Below in Table 1 is an exemplary logic table that defines when the door lock 110 can change the state of a Wi-Fi transceiver:

TABLE 1

| Lock State | Wi-Fi On | Wi-Fi Standby/Off | Wi-Fi On, then Standby/Off (Status update) |
|---|---|---|---|
| Lock engaged/Door closed | | X | |
| Lock engaged/Door open | | X | |
| Lock retracted/Door closed | X | | |
| Lock retracted/Door open | | X | |
| Lock engaged/Door Closed/PIR triggered | X | | |
| Any State Change | | | X |

Any such logic tables could preferably be defined by an admin user via a user-interface of remote device 140.

In some embodiments, the instructions could be to be to simply unlock the door immediately, unlock the door at a threshold time value, or to change the state of a sleeping device to transmit gleaned data to the server 120 or the remote device 140. For example, the instructions could cause the processor 111 to change the state of a sleeping camera and/or microphone, and transmit that data (live or in a recorded segment) to the server 120 or remote device 140. The instructions could also be layered to gradually waken sleeping devices sequentially. For example, a motion sensor that is always active could detect an entity in a defined area, which then wakes a transceiver from a sleep state to establish a link with the server 120, and send a request for instructions. The instructions could include waking a camera to capture an image of the entity, and comparing that image against the local facial recognition image or video frame stored in the door lock 110. If the captured image matches the local facial recognition image or video frame, the instructions could then wake a microphone, speaker, and display, and initiate a video chat phone call with the remote device 140 or unlock the door lock 110. Using instructions that layer instructions to change devices from a sleeping state to an active state optimizes power use by the door lock 110.

In some embodiments, the server 120 could transmit the authentication e-code to both the door lock 110 and to a remote device 140 in response to the triggering signal from the door lock 110. Generally, the remote device 140 that receives such an authentication e-code/e-key is not the same as an administration remote device. In this manner, a third party, such as a friend or a delivery person, could be given access to unlock the door lock 110.

An e-code could be pre-configured by a user of the system, for example an authenticated admin user of the door lock 110 or an authenticated admin user of the remote device 140, or could be dynamically generated by either the server 120 or the door lock 110 in response to a triggering event. Dynamic generation of the e-code can be performed using a seed that is created by the app and stored on the server 120, door lock 110 and remote device 140. With every defined interval, 6 hours for example, using the system clock and the stored seed, a random e-code is generated from the seed and a predefined function and that e-code will be the same across all 3 devices because of the same seed. This way, if the lock 110 is offline (e.g. the transmitter is in sleep mode), an app on remote device 140 can still retrieve a code (or generate a code) for use by a friend who is using remote device 140 and is at a door to enter a house.

The software saved on the memory 112 could also be programmed to cause the door lock processor 111 to randomly require a pre-code to be entered into a user interface of the door lock 110 prior to entry of the e-code. This pre-code could be provided directly by the door lock 110 (e.g. by illuminating a key on a keypad, encouraging a user to press that key before illuminating the next key in the sequence) or could be provided to the remote device 140. Using pre-codes minimizes wear and tear of only certain portions of a user interface over time, which is particularly important in embodiments where the same e-code is used over and over again by the same user interface.

In some embodiments, the door lock 110 could also be configured to transmit notifications to the server 120, which are relayed to the remote device 140. For example, if door lock 110 detects that a door lock is in a closed state (indicating that the door is closed) and that the door lock is in an unlocked state, the door lock 110 could wake a transceiver and transmit a "door unlocked" notification. If the door lock 110 detects that its battery is running low, the door lock 110 could transmit a "battery low" notification. Any suitable sensor could be used to trigger such notifications, such as the door lock changing state between locked and unlocked (e.g. via a non-electric, mechanical lock), the door changing state between open and closed, a sensor detecting an entity, a sensor detecting a matching biometric fingerprint, a user interface receiving an e-code, etc. Such notifications could include any combination of detected information related to the triggering event, such as a method of unlocking (e.g. an e-code, e-key, biometric characteristic detection, or mechanical key), a time of entry, or an identifier associated with the e-code or e-key. In some embodiments, the door lock 110 could transmit each notification dynamically as it detects triggering events, while in other embodiments the door lock 110 could queue the notifications in memory 112, which are then sent to the server 120 upon another triggering event (e.g. periodically every predetermined time or time period, or when requested by the remote device 140).

Certain functions in the door lock 110 can be triggered with timing. For example, if the door is closed but not locked, the processor 111 can trigger the door lock 110 to lock after a predetermined time period of inactivity.

The door lock 110 could be configured to change the state of a device from an active state to a sleep state via any number of triggers. For example, after a threshold period of time passes since the door lock 110 has received an input via any of its sensors or user interfaces, the door lock 110 could change the state of designated devices to a sleep state, which could then be awaked when the door lock 110 receives other pre-defined triggers. In some embodiments, the door lock 110 could be configured to switch off or sleep any number of pre-defined electronic devices when a "battery low" state of the battery is detected. The "battery low" state could be a dynamically defined state that is set by an admin user, and several "battery low" states could be defined (e.g. a 30%-50% battery low state could trigger different events than a 0%-30% battery low state)

The embodiments disclosed herein could be used to delay sending requests/commands from a remote device to an inventive door lock because execution is not necessary when no one is outside the door. For example, the resident of a home could be away from home and may like to send an e-code for unlocking the door to a friend who will be visiting later that day. The resident can create an e-code on a remote device and transmit it to both the friend and the door lock via a server. If the door lock is in the sleep mode, the e-code is stored in the cloud server for transmission later, for example, when the door lock detects a motion via a motion sensor. In another embodiment, the resident could receive a package from a delivery service during the day as well and could then send an e-code to the delivery service and to the door lock via a server. Now, if the delivery person arrives first, the moment the motion sensor is triggered by a person approaching the door lock, the transceiver wakes from the sleep mode and thereafter the e-code is then sent from the server to the door lock and the delivery person so that both the friend and the delivery service can unlock the door lock using their respective e-code. The e-codes could be different and associated with different unique identifiers of the friend and the delivery person, allowing the resident to know when the delivery person used that e-code versus when the friend used that e-code.

The door lock 110 could be installed in any suitable door that requires a lock, and does not need to be limited to standard doors for humans to walk through. The door lock 110 could be installed in any door to an entrance or egress of any cavity, for example cabinetry, safes, and trap doors.

Figure 2:
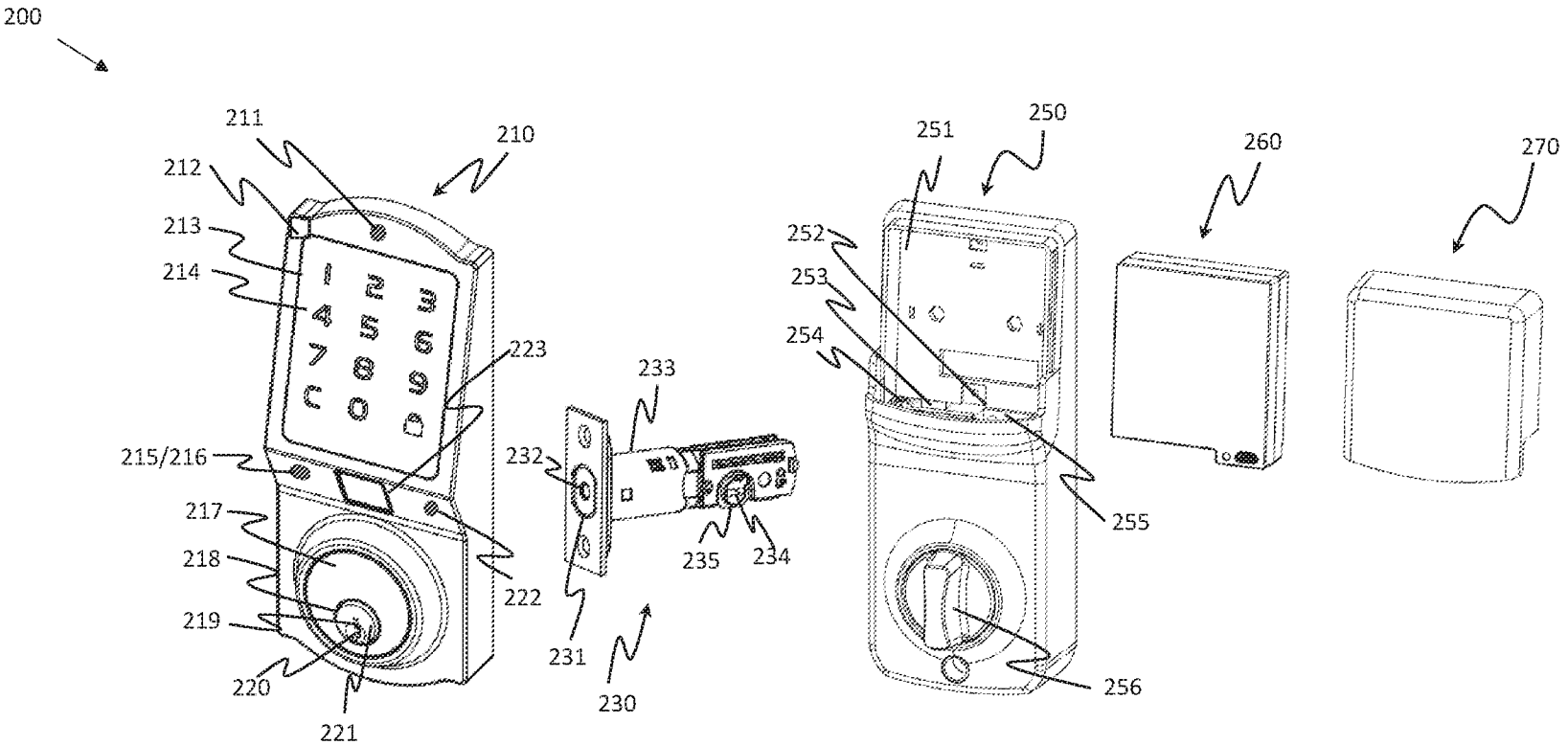
FIG. 2 is an exploded view of another embodiment of a door lock system.

FIG. 2 shows an exploded view of an embodiment of an inventive door lock 200 having an outer housing 210, a latch mechanism 230, an inner housing 250, a power source 260, and a cover 270.

The outer housing 210 is shown as comprising a housing of a door lock having a camera 211, solar panel 212, keypad user interface 213 with characters 214, microphone 215, speaker 216, cylinder 217, shear line 218, tumbler 219, keyway 220, plug 221, motion sensor 222, and biometric sensor 223. A latch mechanism 230 is shown as comprising a deadbolt 231, inner cylinder or anti-saw pin 232, latch housing 233, latch cam 234, and latch cam slot 235. An inner housing 250 is shown as comprising a battery cavity 251, transceiver 252, antenna 253, modem 254, battery charger 255, and thumb-turn lever 256. As previously disclosed, any suitable number and/or combination of electronic devices could be incorporated into the outer housing 210, latch mechanism 230, or inner housing 250.

The door lock 200 is generally installed in a door by installing the latch 230 in a recess of the door, and installing the outer housing 210 on an exterior side of the door and inner housing 250 on an interior side of the door. The latch mechanism 230 is typically installed such that the deadbolt 231 is capable of extending into a recess of a strike plate (not shown), which would lock the door if extended into the strike plate. The deadbolt 231 is movable in a linear position between the lock position and an unlock position, which is extended via a mechanical latch cam 234. The mechanical latch cam 234 is engaged via the latch cam slot 235, which is generally coupled to a tumbler 219 of the keyway 220, spindle 320, and to an electronic motor (not shown), allowing a user on the outside to use a mechanical key inserted into the keyway 220 to lock/unlock the deadbolt 231 using a mechanical mechanism, a user on the inside to use the thumb-turn lever 256 to lock/unlock the deadbolt 231 using a mechanical mechanism, a user on the outside to enter an e-code into one or both of the keypad user interface 213 and the biometric sensor 223 to lock/unlock deadbolt 231 using the electronic motor, a user of a remote device to lock/unlock deadbolt 231 using the electronic motor, or new users to use their app on their remote devices provided by e-keys from an authorized user to lock/unlock deadbolt 231 using the electronic motor. The pin tumbler 220 is shown as a traditional pin tumbler that is rotatable within case 217 when a key that matches the pin tumbler 220 such that the plug 223 can rotate along the shear line 218. Rotation of the latch cam 234 in one direction extends the deadbolt 231 in one direction while rotation of the latch cam 234 in another direction retracts the deadbolt 231 in the other direction.

The deadbolt 231 also comprises a recess having an anti-saw pin 232 that rotates about its axis, which prevents a thief from cutting through the deadbolt 231. In some embodiments, the anti-saw pin 232 could comprise or compose a mechanism that allows the door lock 200 to sense the locking state of the latch mechanism 230. For example, the cylinder 232 could comprise a magnetic material which is sensed by a sensor of the door lock 200. Thus, when the deadbolt 231 is extended, the magnetic material in the cylinder 232 is further from the sensor, creating a weak magnetic field that indicates that latch mechanism 230 is in the locked state, and when the deadbolt 231 is retracted, the magnetic material in the cylinder 232 is close to the sensor, creating a strong magnetic field and indicates that the latch mechanism 230 is in an unlocked state. In other embodiments, the cylinder 232 could be coupled to a magnetic sensor itself, while a magnet could be placed in a strike box attached inside the door frame, or inside the door frame itself, or mounted to a surface of the door frame itself, and a stronger sensed magnetic field indicates that the latch mechanism 230 is in a locked state. Other sensing mechanisms could be utilized, such as a circuit that is closed when deadbolt 231 is extended. Similarly, a door position sensor (not shown) with a magnetometer could be used to determine the change in position of the door between a closed state and an open state depending upon the distance of the latching mechanism to a striking plate or the door frame.

The keypad user interface 213 and/or biometric sensor 223 could be used to lock and unlock the latch mechanism 230 using an electronic motor (not shown). The keypad user interface 213 preferably comprises a plurality of physical, discrete, movable buttons that each correspond to an alphanumeric character, such as a number, letter, symbol, or group of characters. While the keypad user interface 213 is shown as a tactile keypad, any suitable input device could be used, such as a touchscreen or a touchpad. The keypad user interface 213 accepts e-codes, and could be configured to require the user to enter a random code prior to entering the preset e-code, to reduce the likelihood of onlookers determining the preset unlock code from the hand movement of the user entering the preset unlock code or from the fingerprint smudge or wear on the buttons or touchscreen. In one embodiment, the random code could be a few characters illuminated on the keypad user interface 213, each one turning off after a character is pressed by the user. After all the characters of the random code are pressed, the user can enter the preset unlock code to retract the deadbolt 231 and unlock the door. In another embodiment, each character of the random code is shown/visible to the user one at a time and must be pressed before the next character is displayed. After all the characters of the random code are pressed, the user can enter the preset unlock e-code to retract deadbolt 231 and unlock the door The keypad user interface 213 is used to accept an e-code while the biometric sensor 223 (shown euphemistically as a fingerprint sensor) could be used to accept a biometric characteristic of the user. In some embodiments, keypad user interface 213 and biometric sensor 223 could be configured to be devices that are in the sleep mode, and are only woken up after motion sensor 222 has detected an entity in a defined area. In other embodiments, the keypad user interface 213 is a device that is always on, and could be used to wake up other elements of the door lock 200, such as the transceiver 252 (shown here as an RF module). When such a trigger is received, a processor in the door lock 200 could then trigger one or more electronic devices to wake up, such as a transceiver that transmits a signal to a remote server that an entity has been detected, a microphone 215 that records sounds to be saved and/or transmitted, a camera 211 that records video to be saved and/or transmitted, and/or a speaker 216 that plays a pre-recorded sound recording. Here, a solar panel 212 could also be installed on an exterior surface of the outer housing 210 to help to recharge the battery 260, installed within the battery cavity 251 to abut the battery charger 255.

The interior housing 250 also comprises a transceiver 252 electronically coupled to the modem 254 and the antenna 253 to connect to a network (not shown). The hardware is generally configured using a separate user interface of a remote device, such as a handheld cellphone or a desktop computer. Configuration can be performed using any suitable means, such as a Bluetooth or a Wi-Fi connection with the modem 254. The battery 260 can be, for example, a rechargeable battery or single-use batteries held in place by the battery cover 270.

Figure 4:
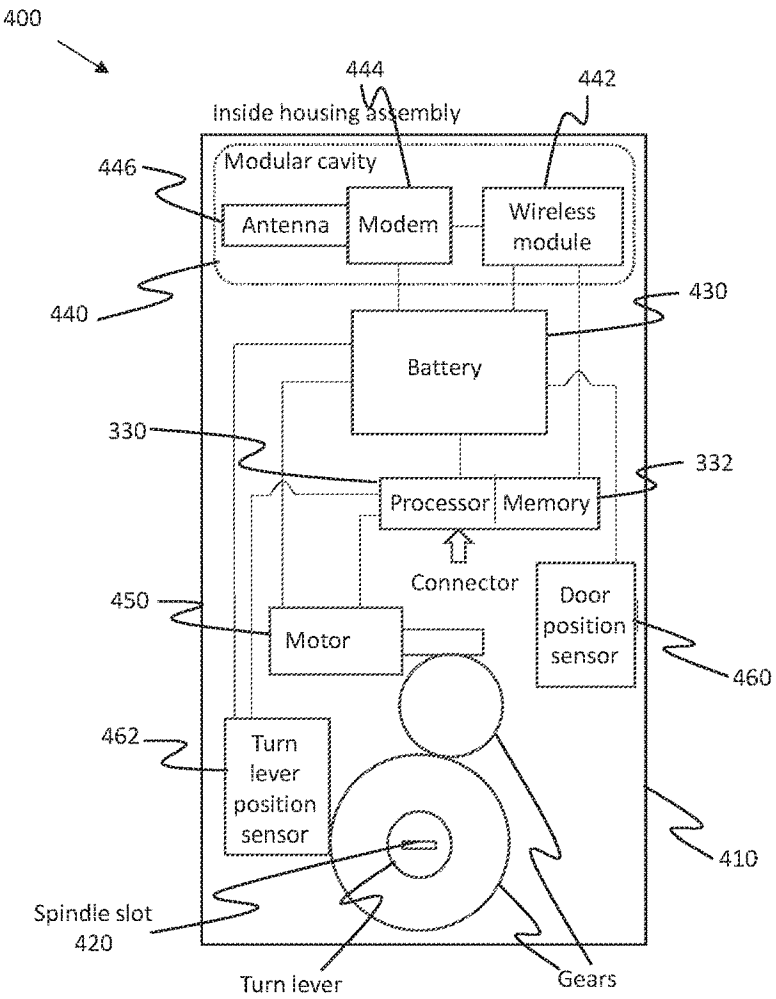
FIG. 4 is a rear plan view of the housing assembly of FIG. 3.
Figure 3:
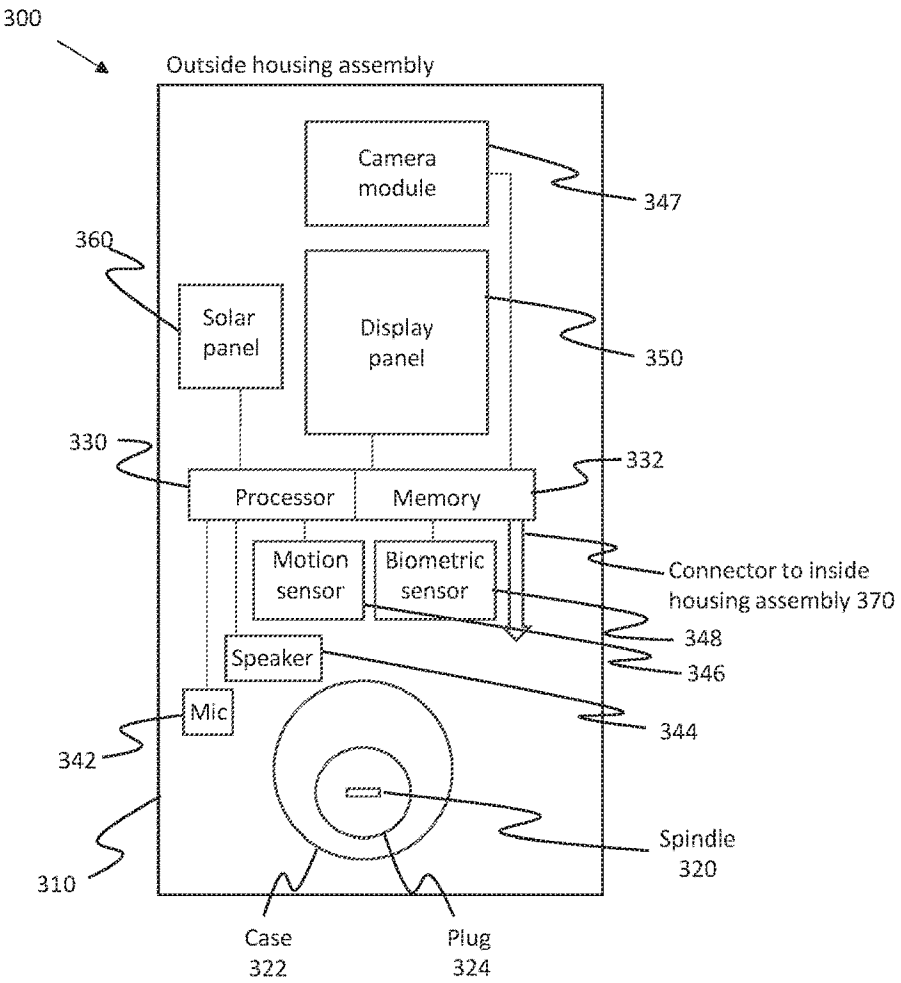
FIG. 3 is a front plan view of a housing assembly of an embodiment of a door lock system.

FIGS. 3 and 4 show embodiments of the logical components of an inventive outer housing assembly 300 and inner housing assembly 400, such as the outer housing 210 and the inner housing 250 of FIG. 2. The outer housing assembly is shown as comprising an outer housing 310, spindle 320, case 322, plug 324, processor 330, memory 332, microphone 342, speaker 344, motion sensor 346, camera module 347, biometric sensor 348, display panel 350, solar panel 360, and connector to the inside housing assembly 370. The inner housing assembly 400 is shown as comprising inner housing 410, processor/memory 330, spindle slot 420, gears 422, thumb-turn lever 424, battery 430, modular cavity 440, wireless module 442, modem 444, antenna 446, motor 450, and door position sensor 460. The connector 370 is a bus that couples the electronic components within the outside housing assembly 300 with inside housing assembly 400.

As shown, both the inner and outer housing assemblies 300 and 400 have a plurality of electronic sensors, shown here as a microphone 342, motion sensor 346, biometric sensor 348, camera module 347, door position sensor 460, and turn lever position sensor 462. Some or all of these sensors may be defined as devices, capable of being changed to a sleep state to save power drain on battery 430. In some embodiments, at least some of the sensors are active at all times, such as the motion sensor 348, door position sensor 460, and turn lever position sensor 462. When sensors are triggered by a threshold value (e.g. the turn lever position sensor 462 senses that the lever has traveled more than 50% of its distance from the locking position to an unlocking position), the processor 330 could then follow instructions to perform a task, such as waking up the wireless module 442, modem 444, and antenna 446 to transmit a notification that the door has been unlocked, or by saving that event and time-stamp to the memory 332 to be transmitted to a server at a later time. Preferably, the antenna 446 extends through a recess to an exterior portion of the inner housing assembly 400—particularly if the inner housing assembly 400 comprises a metallic material.

Electronic motor 450 is an electrical motor that turns the plug 324 within the case 322 by turning gears 422, which rotates the spindle slot 420 attached to the spindle 320. By using the electronic motor 450, various devices, such as a wirelessly connected remote device, or display panel 350, could transmit instructions or codes to the processor 330, which could then activate the electronic motor 450 to lock/unlock the door.

Figure 5:
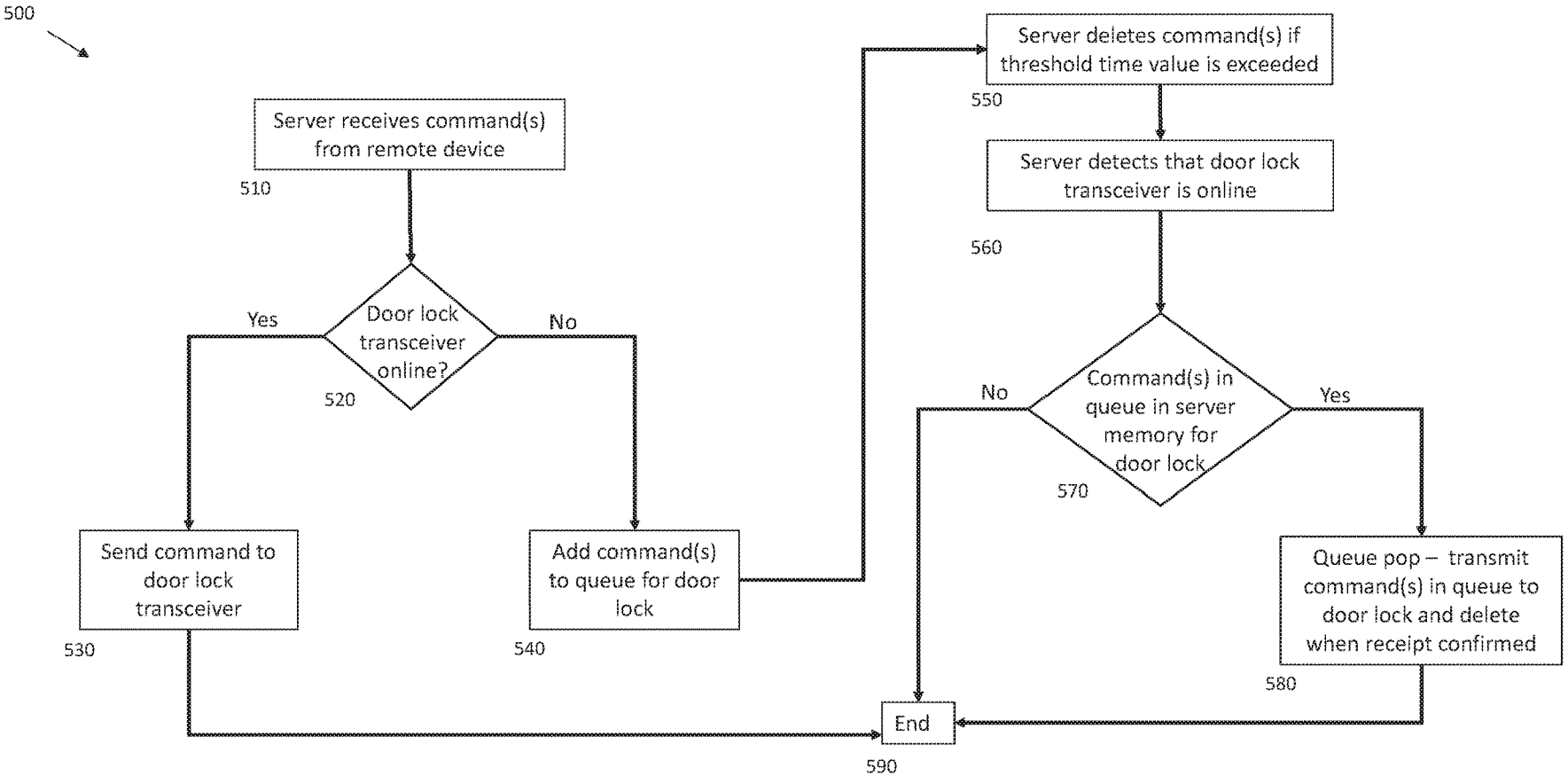
FIG. 5 shows a method of a server processing received door lock execution instructions.

FIG. 5 shows an embodiment of a method 500 of a server that processes door lock execution instructions. In block 510, the server receives commands via a network connection from a remote device, such as an application installed on a mobile device or a remote desktop computer submitting commands via a website. In block 520, the server checks whether the door lock transceiver is online, for example, by an existing TCP session with the door lock. A lack of a TCP session with the door lock indicates the door lock is offline. If the door lock transceiver is online, the server can transmit any of the received commands to the door lock transceiver in block 530.

If the server determines that the door lock transceiver is not online in block 520, the server can append any commands received to a queue in the server for the door lock in block 540. Each door lock will be assigned a dedicated queue, as the server may comprise a plurality of queues. The queue can be a FIFO queue or a dynamically sequenced queue, which could be utilized to allow a user to dynamically alter the contents of a command queue saved on the server before the server transmits the commands to the door lock.

In some embodiments, a command might be added as a function of a threshold time value. For example, an instruction (or set of instructions) may only be executed on a door lock apparatus before a threshold time value, or within a time period. In block 550, if a threshold time value is exceeded, the server may delete one or more commands to save memory on the server, and to minimize bandwidth usage between the server and the door lock apparatus. In some embodiments, the commands or instructions with a threshold time value may be sent to the door lock from the server and the deletion of the command is executed by a processor on the door lock rather than a processor on the server. In block 560, the server detects that the door lock transceiver is online, triggered by, for example, a motion sensor detecting the presence of a person approaching the door lock.

In block 570, after the server determines that the door lock transceiver is online, the server could review the queue to determine if there are any commands that need to be transmitted to the door lock apparatus. In block 580, if the queue assigned to the door lock contains commands, the server could then transmit any and all commands to the door lock apparatus via the now online door lock transceiver, and delete the commands once the door lock apparatus confirms receipt of the commands. In some embodiments, this can be done in a FIFO manner, popping the oldest command off of the queue and transmitting it to the door lock apparatus before popping the next command off of the queue.

Figure 6:
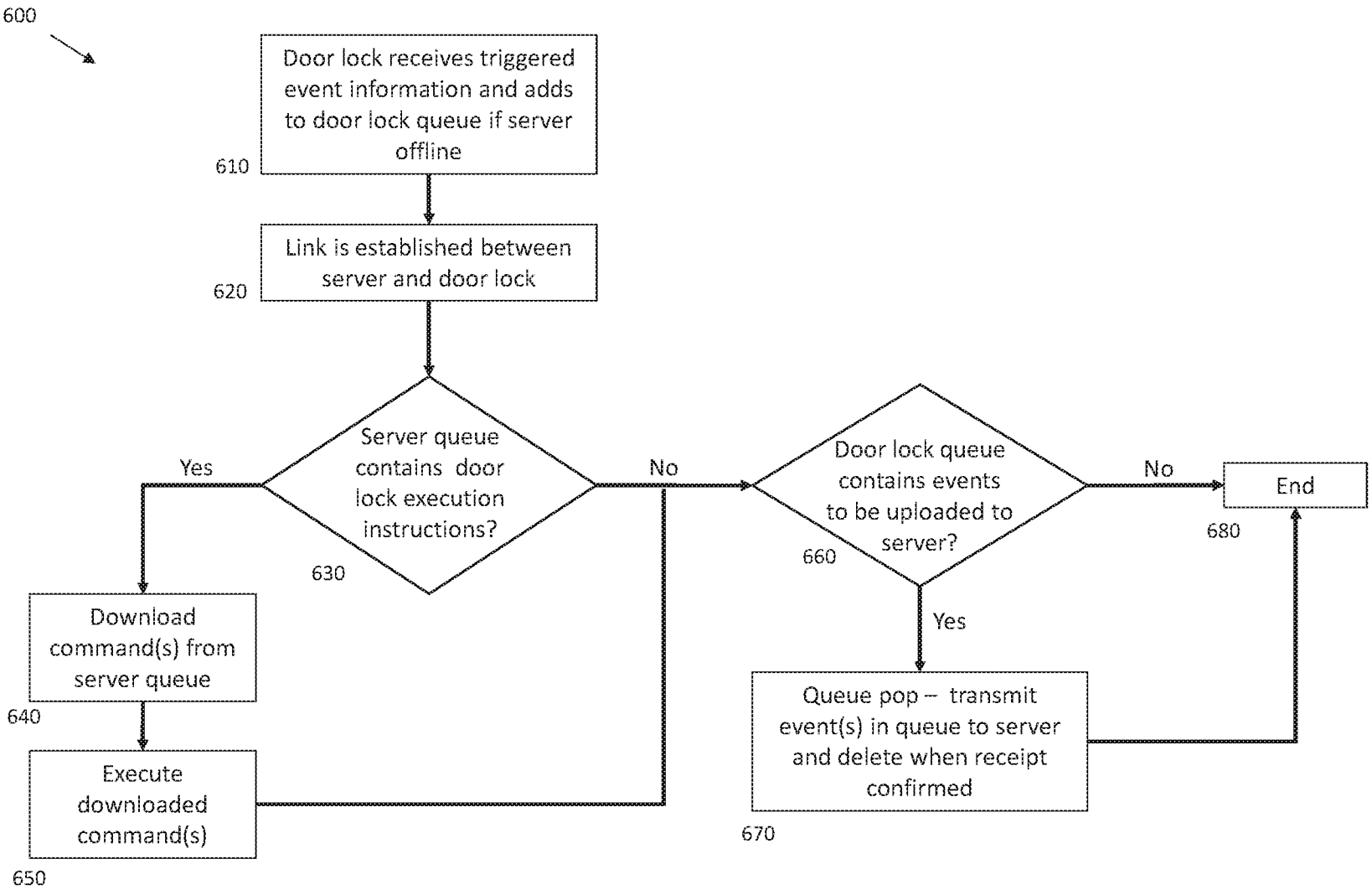
FIG. 6 shows a method of a door lock apparatus processing received door lock execution instructions.

FIG. 6 shows an exemplary method 600 of a door lock apparatus that processes door lock execution instructions received from a server. In this embodiment, the door lock apparatus has a transceiver that is at a sleep state. In block 610, the door lock apparatus receives event information, such as the door opening or unlocking, and adds the event information to a door lock queue stored in a memory of the door lock while the server happens to be offline. In block 620, the door lock transceiver establishes a link (e.g., TCP session) with the server and queries the server about the existence of door lock execution instructions. The door lock may also send any event information in the door lock queue to the server. Similar to the queue in the server, the door lock apparatus queue could be a FIFO queue.

In block 630, the server queue receives the signal from the door lock transceiver, and indicates to the door lock apparatus whether it contains door lock execution instructions. If the server queue contains door lock execution instructions, the door lock transceiver could then download one or more of the instructions from the server queue in block 640 and could then execute the downloaded instructions in block 650. If the instruction has a threshold time value, as discussed above with regards to FIG. 5, the instruction can be downloaded from the server and the door lock can determine if the instruction has expired, and if so, not execute the instruction.

Whether or not instructions are downloaded and executed, the door lock apparatus then proceeds to block 660 to determine whether the door lock queue contains events that need to be uploaded to the server. If the door lock apparatus contains any events that need to be uploaded to the server, the events could then be transmitted to the server via a network in block 670. It should be noted that blocks 630 and 660 can be performed in any order or simultaneously.

Once the door lock apparatus has finished communicating with the server, even if the instructions have yet to be executed (e.g. if the instructions can only trigger after a threshold time value has been reached or when it receives some sort of input via a user interface of the door lock), the door lock apparatus could end communication with the server 680, for example by switching the transceiver to a sleep state. In some embodiments, a threshold time value needs to first pass after the door lock apparatus breaks off communication with the server before the transmitter is switched to a sleep state, for example 5 minutes or 10 minutes.

Although the present disclosure has been discussed with respect to various embodiments, it should be recognized that the present disclosure comprises novel and non-obvious claims supported by this disclosure.

What is claimed is:

1. An electronic door lock system, comprising:
- a server having a server memory with door lock execution instructions and a server processor;
- a door lock;
- an electronic motor that locks and unlocks the door lock;
- a motion sensor that monitors a defined area;
- a transceiver that communicates with the server via a network,
  - wherein the transceiver has an active state and a sleep state;
- a door lock processor; and
- a door lock memory having door lock default instructions that, when executed by the door lock processor, perform the following actions:
  - switches the transceiver to active mode when the motion sensor detects an entity in the defined area;
  - receives the door lock execution instructions from the server via the network using the transceiver when the transceiver is switched to active mode; and
  - executes the door lock execution instructions to activate the electronic motor to unlock the door lock.

2. The electronic door lock of claim 1, further comprising:
- a system clock,
- wherein the door lock execution instructions, when executed by the door lock processor, perform the following actions:
  - activates the electronic motor to unlock the door lock after the system clock reaches a threshold time value and when the motion sensor detects an entity in the defined area.

3. The electronic door lock of claim 1, wherein the server deletes a portion of the door lock execution instructions when a server clock reaches a threshold time period.

4. The electronic door lock of claim 1, wherein the door lock default instructions, when executed by the door lock processor, further perform the following actions:
- periodically queries the server via the network when the transceiver is in sleep mode;
- receives additional door lock execution instructions from the server via the network using the transceiver when the server indicates that additional door lock execution instructions are saved on the server memory; and
- executes the additional door lock execution instructions.

5. The electronic door lock of claim 1, further comprising a housing that holds the transceiver, the door lock processor, and the electronic motor.

6. The electronic door lock of claim 1, further comprising:
- an electronic user interface,
- wherein the door lock execution instructions, when executed by the door lock processor, perform the following actions:
  - receives a code from the electronic user interface,
  - compares the received code to a lock code from the door lock execution instructions;
  - activates the electronic motor to unlock the door lock when the received code matches the lock code from the door lock execution instructions.

7. The electronic door lock of claim 6,
- wherein the door lock execution instructions, when executed by the door lock processor, further transmits an entity detected signal to the server via the network, and
- wherein the server transmits the lock code to a remote device upon receipt of the entity detected signal.

8. The electronic door lock of claim 6, further comprising:
- a system clock,
- wherein the door lock execution instructions, when executed by the door lock processor, prevents the electronic motor from unlocking the door lock when the received code is received outside a threshold time value.

9. The electronic door lock of claim 6, wherein the door lock execution instructions, when executed by the door lock processor, deletes the door lock execution instructions when the system lock reaches a threshold time value.

10. The electronic door lock of claim 1, further comprising:
- a door lock sensor that detects a locking state of the door lock;
- a door open sensor that detects an opening state of the door lock;
- wherein the door lock default instructions, when executed by the door lock processor, further perform the following actions:
  - switches the transceiver to sleep mode when the door open sensor detects that the door lock is in an open state;
  - switches the transceiver to sleep mode when the door open sensor detects that the door lock is in a closed state and the door lock sensor detects that the door lock is in a locked state; and
  - switches the transceiver to active mode and transmits a door unlocked signal to the server via the network when the door open sensor detects that the door lock is in a closed state and the door lock sensor detects that the door lock is in an unlocked state.

11. The electronic door lock of claim 10, further comprising:
- an electronic user interface,
- wherein the door lock default instructions, when executed by the door lock processor, further perform the following actions:
  - receives a code from the electronic user interface, compares the received code to a lock code from the door lock default instructions;

activates the electronic motor to unlock the door lock when the received code matches the lock code from the door lock default instructions.

12. The electronic door lock of claim 1, further comprising:

a biometric sensor, wherein the door lock execution instructions, when executed by the door lock processor, perform the following actions:

receives a biometric fingerprint from the biometric sensor, compares the received biometric fingerprint to a lock biometric fingerprint from the door lock execution instructions;

activates the electronic motor to unlock the door lock when the received biometric fingerprint matches the lock biometric fingerprint from the door lock execution instructions.

13. The electronic door lock of claim 12, wherein the biometric sensor comprises a fingerprint sensor.

14. The electronic door lock of claim 13, wherein the biometric sensor comprises a camera, and wherein the received biometric fingerprint comprises a facial recognition fingerprint.

15. A method to optimize power consumption of an electronic door lock, comprising:

saving door lock execution instructions on a server memory of a server;

monitoring a defined area using a motion sensor;

switching a transceiver to sleep mode when the motion sensor detects no entities in the defined area;

switching the transceiver to active mode when the motion sensor detects an entity in the defined area;

receiving the door lock execution instructions from the server via a network using the transceiver when the transceiver is switched to active mode; and executing the door lock execution instructions to activate an electronic motor to unlock a door lock.

16. The method of claim 15, further comprising deleting a portion of the door lock execution instructions when a threshold time value is reached.

17. The method of claim 15, wherein the step of executing the door lock execution instructions further comprises:

receiving a code from an electronic user interface;

comparing the received code with a lock code from the door lock execution instructions; and activating the motor to unlock the door lock when the received code matches the lock code from the door lock execution instructions.

18. The method of claim 17, further comprising:

transmitting a triggering signal to the server via the network using the transceiver when the transceiver is switched to active mode; and transmitting the lock code from the server to a remote device when the triggering signal is received by the server.

19. An electronic door lock, comprising:

a locking mechanism;

an electronic motor that locks and unlocks the locking mechanism;

a motion sensor that monitors a defined area;

a transceiver that communicates with a server via a network, wherein the transceiver has an active state and a sleep state;

a door lock processor; and a door lock memory having door lock default instructions that, when executed by the door lock processor, perform the following actions:

switches the transceiver to sleep mode when the motion sensor detects no entities in the defined area;

switches the transceiver to active mode when the motion sensor detects an entity in the defined area;

receives a set of door lock execution instructions from the server via the network using the transceiver when the transceiver is switched to active mode; and executes the door lock execution instructions to activate the electronic motor to unlock the locking mechanism.

20. The electronic door lock of claim 19, further comprising:

an electronic user interface, wherein the door lock execution instructions, when executed by the door lock processor, further perform the following actions:

receives a code from the electronic user interface, compares the received code with a lock code from the door lock execution instructions;

activates the electronic motor to unlock the door lock when the received code matches the lock code from the door lock execution instructions.

21. The electronic door lock of claim 19, further comprising:

a biometric sensor, wherein the door lock execution instructions, when executed by the door lock processor, further perform the following actions:

receives a biometric fingerprint from the biometric sensor, compares the received biometric fingerprint to a lock biometric fingerprint from the door lock execution instructions;

activates the electronic motor to unlock the door lock when the received biometric fingerprint matches the lock biometric fingerprint from the door lock execution instructions.

* * * * *